US009051745B1

(12) United States Patent
Parr et al.

(10) Patent No.: US 9,051,745 B1
(45) Date of Patent: Jun. 9, 2015

(54) TELESCOPING CONCRETE FORM ASSEMBLY

(71) Applicants: Kevin Parr, Beallsville, OH (US); Howard Shackelford, Triadelphia, WV (US); Lawrence Charles Kelly, Wheeling, WV (US); James Anthony Schau, Benwood, WV (US)

(72) Inventors: Kevin Parr, Beallsville, OH (US); Howard Shackelford, Triadelphia, WV (US); Lawrence Charles Kelly, Wheeling, WV (US); James Anthony Schau, Benwood, WV (US)

( * ) Notice: Subject to any disclaimer, the term of this patent is extended or adjusted under 35 U.S.C. 154(b) by 0 days.

(21) Appl. No.: 14/083,656

(22) Filed: Nov. 19, 2013

(51) Int. Cl.
*E04G 9/08* (2006.01)
*E01C 19/50* (2006.01)

(52) U.S. Cl.
CPC ..... *E04G 9/08* (2013.01); *E01C 19/508* (2013.01); *E01C 19/502* (2013.01)

(58) Field of Classification Search
CPC ..... E01C 5/02; E01C 5/08
USPC ..... 249/2, 3, 4, 5, 6, 7, 98, 99
See application file for complete search history.

(56) References Cited

U.S. PATENT DOCUMENTS

| | | | | | |
|---|---|---|---|---|---|
| 1,897,530 | A | * | 2/1933 | Pandolfi | 249/4 |
| 2,611,169 | A | * | 9/1952 | Torrelli | 249/4 |
| 2,949,656 | A | | 8/1960 | Pleitgen et al. | |
| 3,136,023 | A | * | 6/1964 | Von Drasek | 249/192 |
| 3,288,426 | A | * | 11/1966 | Simpson | 249/192 |
| 3,395,884 | A | * | 8/1968 | Laukala | 249/4 |
| 3,680,711 | A | | 8/1972 | Brucker | |
| 4,121,804 | A | * | 10/1978 | O'Leary | 249/187.1 |
| 4,248,024 | A | | 2/1981 | Dahlstrom | |
| 4,342,440 | A | | 8/1982 | Eyden | |
| 4,720,016 | A | | 1/1988 | Kay | |
| 4,745,724 | A | | 5/1988 | Reetz | |
| 4,758,393 | A | | 7/1988 | Cazenave et al. | |
| 5,079,884 | A | | 1/1992 | Menchetti | |
| 5,107,648 | A | | 4/1992 | Roby | |
| 5,655,336 | A | | 8/1997 | Azar | |
| 5,884,439 | A | * | 3/1999 | Hess et al. | 52/155 |
| 6,742,758 | B2 | * | 6/2004 | Janesky | 249/7 |
| 6,866,239 | B2 | * | 3/2005 | Miller et al. | 249/3 |
| 2006/0179787 | A1 | | 8/2006 | Bilowol | |
| 2013/0069265 | A1 | | 3/2013 | Djoboulian | |

OTHER PUBLICATIONS

Kevin Parr et al., PCT/US2014/066155 International Search Report and Written Opinion, Feb. 19, 2015, 13 pages.

* cited by examiner

*Primary Examiner* — Michael Safavi
(74) *Attorney, Agent, or Firm* — Eckert Seamans Cherin & Mellott, LLC; David C. Jenkins

(57) ABSTRACT

A telescoping concrete form assembly is provided. The concrete form assembly includes a hollow first member assembly with an elongated hollow body and a generally planar vertical first sidewall, as well as a second member assembly including an elongated body with a medial portion having an outer cross-sectional shape corresponding to the first body inner cross-sectional shape. The second member is slidably disposed within the first member and is structured to move between a retracted first position, wherein the second member is substantially disposed within the first member, and a second position, wherein the second member extends from the first member. The second body first end is a reduced portion. When the second body is in the second position, the second body is further in an offset position wherein a portion of the second body outer surface substantially aligns with a portion of the first body outer surface.

8 Claims, 4 Drawing Sheets

TELESCOPING CONCRETE FORM ASSEMBLY

BACKGROUND OF THE INVENTION

1. Field of the Invention

The disclosed and claimed concept relates to concrete forms and, more specifically, to a telescopic concrete form.

2. Background Information

A concrete form is a frame used to support wet concrete and define the shape of the resulting concrete slab. Traditionally, the concrete form was a wooden board, such as, but not limited to, a 2"×6", a 2"×8", or a 2"×10". The wooden board could have a release coating applied thereto. Such boards would be positioned so as to enclose the vertical sides of the resulting concrete slab. The wet concrete would be poured within the forms, leveled off by screeding the concrete (i.e. moving a straight edge, usually another board, back and forth over the upper surface of the forms thereby leveling off the concrete), and allowed to dry. The forms were then removed leaving the dry concrete slab. One disadvantage of using wooden boards was that the boards would degrade over time. Another disadvantage was that boards are, typically, cut in standard lengths. Thus, if the form needed to be longer than a standard board, two or more boards would be coupled together until the desired length was obtained. Further, if the form required a key, as discussed below, fabrication of the key required extra wood and time to assemble.

One solution to these disadvantages was to provide a telescoping metal form such as the device disclosed in U.S. Pat. No. 5,655,336. This patent discloses two C-shaped metal members disposed in a spaced, telescoping relationship. The members included a support device disposed on the open side of the C-shaped members. This device has disadvantages as well. First, the upper surface of the inner telescoping member was disposed in a plane parallel to, but below, the plane of the outer member upper surface. The degree to which the surfaces are uneven was exacerbated by spacing ridges on the inner surface of the outer member. These factors created a non-planar upper surface to the form assembly. The non-planar upper surface prevented screeding or caused the screeding to produce a non-planar surface on the concrete. Similarly, the vertical forming surface of the device was uneven as well resulting in vertical face on the slab that included two or more planar surface that were not aligned. Such an uneven vertical face is not desirable on an outer vertical face of a concrete slab.

There is, therefore, a need for an improved concrete form that provides a substantially planar upper surface. There is a further need for an improved concrete form that provides a substantially planar vertical face.

SUMMARY OF THE INVENTION

These needs, and others, are met by at least one embodiment of the disclosed and claimed concept which provides for a telescoping concrete form assembly wherein the inner telescoping member body includes a reduced end on the inner member. That is, the concrete form assembly includes a hollow first member assembly including an elongated body with a first end, a medial portion, a second end, an inner cross-sectional shape and a first generally planar vertical sidewall, as well as a second member assembly including an elongated body with a first end, a medial portion, a second end, and a first generally planar vertical sidewall. The second member medial portion outer cross-sectional shape corresponds to the first body inner cross-sectional shape. Hereinafter, the first member assembly body and second member assembly body are identified as "first body" and "second body," respectively. The second member is slidably disposed within the first member and is structured to move between a retracted first position, wherein the second member is substantially disposed within the first member, and a second position, wherein the second member extends from the first member. The second body first end is a reduced portion. When the second body is in the second position, the second body is further in an offset position wherein a portion of the second body outer surface substantially aligns with a portion of the first body outer surface.

That is, as used herein, "offset" with respect to telescoping members means that the longitudinal axes of the first and second body are substantially parallel, but not directly aligned. Thus, the second body is shifted relative to the first body so that a portion of the second body outer surface aligns with a portion of the first body outer surface. In an exemplary embodiment, the upper surface of the second body is substantially aligned, i.e. substantially co-planar, with the upper surface of the first body. In this configuration, screeding wet concrete adjacent the form assembly provides a substantially planar upper surface to the concrete.

In another exemplary embodiment the outer, first body includes a thin upper surface and the inner, second body outer surface substantially corresponds to the first body inner surface. In this configuration there is a minimal offset between the upper surface of the outer member and the upper surface of the inner member when the inner member is extended. Such a minimal offset allows for screeding wet concrete adjacent the form assembly to provide a substantially planar upper surface to the concrete.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
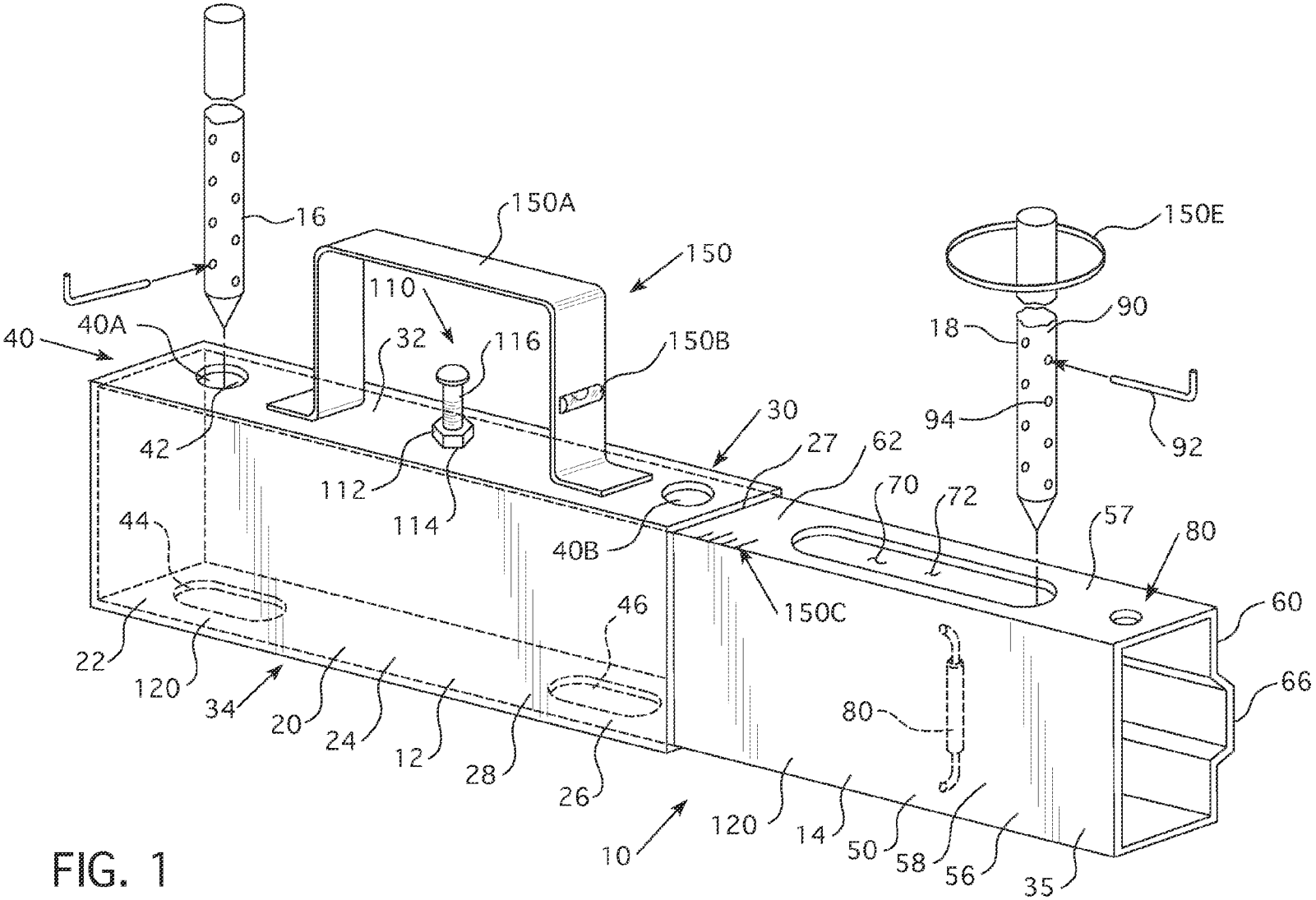
FIG. 1 is an isometric view of one embodiment of a concrete form assembly.

Directional phrases used herein, such as, for example, clockwise, counterclockwise, left, right, upper, lower, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, the statement that two or more parts or components "engage" one another shall mean that the elements exert a force or bias against one another either directly or through one or more intermediate elements or components.

As used herein, the word "unitary" means a component is created as a single piece or unit. That is, a component that includes pieces that are created separately and which are then coupled together as a unit is not a "unitary" component or body.

As used herein, the term "number" shall mean one or an integer greater than one (i.e., a plurality).

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut.

As used herein, "associated" means that the elements are part of the same assembly and/or operate together, or, act upon/with each other in some manner. For example, an automobile has four tires and four hub caps. While all the elements are coupled as part of the automobile, it is understood that each hubcap is "associated" with a specific tire.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction. This definition is modified if the two components are said to fit "snugly" together or "snuggly correspond." In that situation, the difference between the size of the components is even smaller whereby the amount of friction increases. If the element defining the opening and/or the component inserted into the opening are made from a deformable or compressible material, the opening may even be slightly smaller than the component being inserted into the opening. This definition is further modified if the two components are said to "substantially correspond." "Substantially correspond" means that the size of the opening is very close to the size of the element inserted therein; that is, not so close as to cause substantial friction, as with a snug fit, but with more contact and friction than a "corresponding fit," i.e., a "slightly larger" fit. Further, as used herein, "loosely correspond" means that an opening is sized to be larger than an element disposed therein, i.e. there is a gap between the two elements. This means that the increased size of the slot or opening is intentional and is more than a manufacturing tolerance. Further, with regard to a surface formed by two or more elements, a "corresponding" shape means that surface features, e.g. curvature, are similar.

As used herein, and with respect to telescoping members, when two telescoping members have a cross-sectional shape that "substantially corresponds," the outer member and the inner member have an axial length wherein at least one side of the inner surface of the outer member and the outer surface of the inner member side abut each other when the inner member is in the retracted position.

As used herein, and with respect to telescoping members, when two telescoping members have a cross-sectional shape that "loosely corresponds," the outer surface of the inner member has substantially the same cross-sectional shape but has a reduced size whereby, when the longitudinal axes of the inner member and the outer member are aligned, there is a gap between the inner surface of the outer member and the outer surface of the inner member when the inner member is in the retracted position.

As used herein, and with respect to telescoping members, "abut" means that an axial length of the telescoping members are in contact. Further, in a construct wherein an outer telescoping member includes a spacing device on its inner surface, such as, but not limited to, ribs or ridges, structured to space the inner member from the outer member, the members do not "abut" each other for a number of reasons including, but not limited to, the lack of contact over a substantial length of the members.

As used herein, a "generally rectangular cross-section" means that the cross-sectional contour includes three substantially planar members and a generally planar member that selectively includes a non-planar portion such as, but not limited to an elongated, generally linear protrusion.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies.

As used herein, "at" means on or near.

As used herein, a "long" telescopic member or telescopic element has a length of over four feet. A "long" member disposed in a telescopic relationship to another member becomes displaced, i.e. the longitudinal axes of the two telescoping members become non-aligned, or would become displaced if not supported, when the inner telescopic member is extended primarily due to the weight of the inner member.

As used herein, and in relation to a concrete form, a "self-supporting" member is a member or element that has a length of about four feet or less. The term "support[ing]" does not relate to a support that positions the concrete form, but rather the characteristics of the members. For example, a "self-supporting" member disposed in a telescopic relationship to another member does not become displaced, i.e. the longitudinal axes of the two telescoping members do not become non-aligned, when the "self-supporting" member is extended due to the relatively short lengths of the member.

As used herein, an "adhesion resistant" material, or surface, is a material, or surface, that resists adhesion by concrete or mortar.

As used herein with respect to telescoping members, a "reduced portion" means that a portion of the inner telescopic member has substantially the same cross-sectional shape as the inner surface of the outer member, but is sized so that the inner member loosely corresponds to the first body inner cross-sectional shape.

Figure 2:
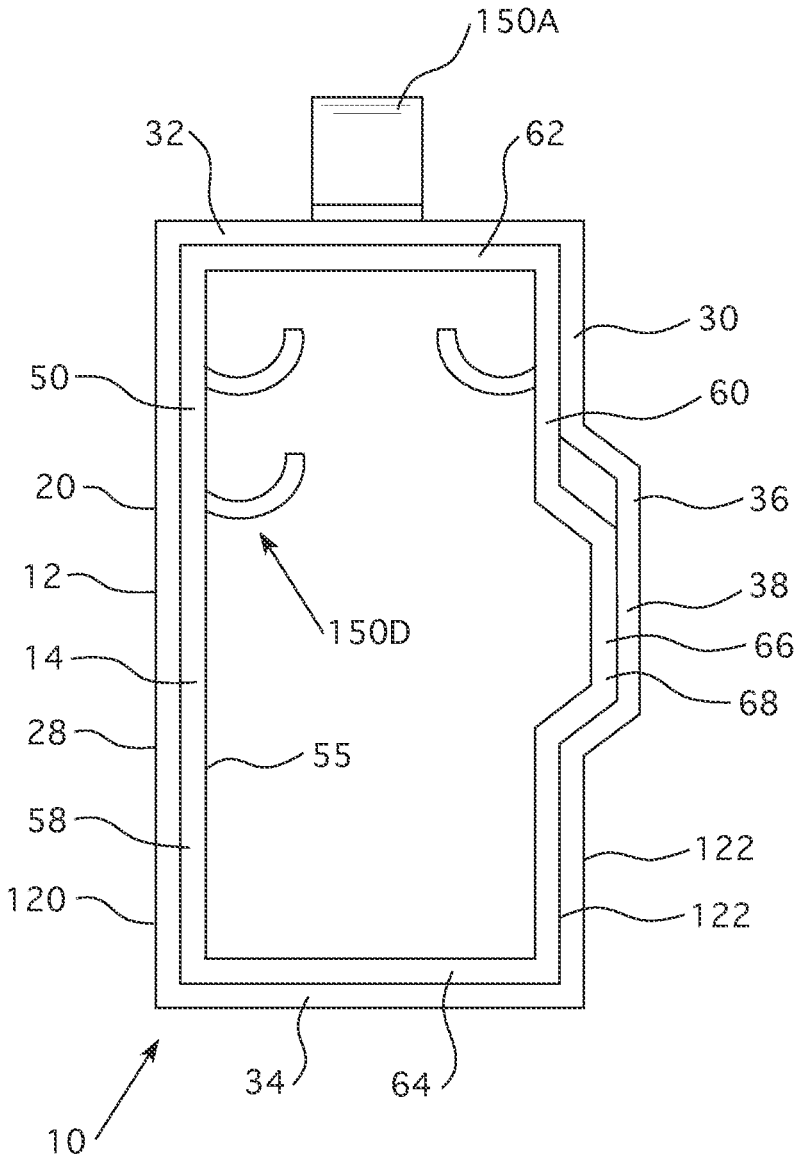
FIG. 2 is an end view of the embodiment of a concrete form assembly shown in FIG. 1.
Figure 3:
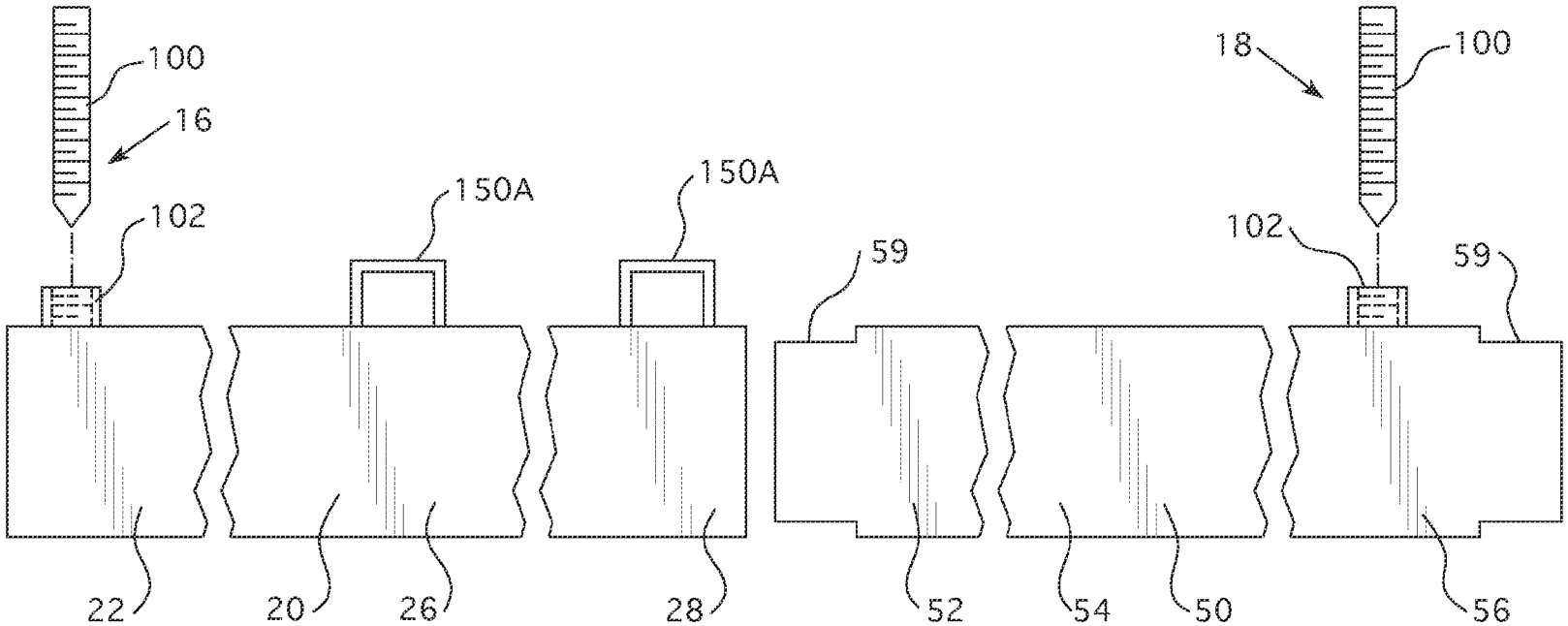
FIG. 3 is a side view of another embodiment of a concrete form assembly.

As shown in FIGS. 1-3, a concrete form assembly 10 includes a hollow first member assembly 12, a second member assembly 14, a first support assembly 16, and a second support assembly 18. The first member assembly 12 includes an elongated body 20 with a first end 22, a medial portion 24, a second end 26 and an outer surface 25. As a hollow member, the first body 20 includes an inner cross-sectional shape and an inner surface 27. The first body 20 further includes a generally planar, vertical first sidewall 28. In an exemplary embodiment, the first body inner surface 27 does not include an offsetting device such as, but not limited to longitudinal ridges or ribs.

In an exemplary embodiment, the first body 20 has a generally rectangular cross-section including a second vertical sidewall 30, an upper sidewall 32 and a lower sidewall 34. In an exemplary embodiment, the first body upper sidewall 32 is a thin sidewall. As used herein, "thin" means having a thickness of between about 0.125 to 0.25 inch. Further, in an exemplary embodiment, the first body upper sidewall 32 is substantially planar. The first body second vertical sidewall 30 is generally planar and, in an exemplary embodiment, includes a longitudinal protrusion hereinafter a "key" 36. That is, as used herein, "generally planar" allows for a protrusion. In an exemplary embodiment, the first body key 36 is generally a trapezoidal protrusion having the minor side offset from the planar portions of the generally planar first body second vertical sidewall 30. Hereinafter, a sidewall including a key 36 is a "keyed sidewall" 38.

In an exemplary embodiment, the first body 20 further includes a number of vertical passages 40 therethrough. Given that the first body 20 is hollow, a passage 40 is defined by an opening 42 through the first body upper and lower sidewalls 32, 34. In an exemplary embodiment, the first body number of vertical passages 40 includes a first passage 40A disposed at the first body first end 22. In an exemplary embodiment, the first body number of vertical passages 40 further includes a second passage 40B disposed at the first body second end 26. Further, in an exemplary embodiment, the first body lower sidewall 34 at the first and second ends 22, 26 each include a support assembly opening 44, 46 described below. As described below, in an exemplary embodiment, the first body first and second passage 40A, 40B openings 42 are generally circular whereas a support assembly opening 44, 46 is a slot and/or is larger than the first body first and second passage 40A, 40B openings 42.

The second member assembly 18 includes a body 50 with a first end 52, a medial portion 54, a second end 56, and an outer surface 57. The second body 50 has an outer cross-sectional shape. The second body 50 further includes a generally planar, vertical first sidewall 58. In an exemplary embodiment, the second body 40 is hollow. In an exemplary embodiment, the second body cross-sectional shape corresponds to the first body 20. That is, the second body outer surface 57 corresponds to the first body inner surface 27. In another exemplary embodiment, the second body medial portion 54 corresponds to the first body inner surface 27 while the second body first end 52 is a reduced portion 59 (FIG. 3). Further, in an exemplary embodiment, the second body second end 56 is a reduced portion 59. In an exemplary embodiment, the reduced portion 59 is reduced by a dimension corresponding to the thickness of the first body sidewalls 28, 30, 32, 34. That is, for example, if a generally planar first body upper sidewall 30 has a thickness of about 0.125 inch, the plane of a second body generally planar upper sidewall 62 (discussed below) at the reduced portion 59 is reduced, shifted, by about 0.125 inch from the second body upper sidewall 62.

In an exemplary embodiment, the second body 50 has a generally rectangular cross-section including a second vertical sidewall 60, a upper sidewall 62 and a lower sidewall 64. Further, in an exemplary embodiment, the second body upper sidewall 62 is substantially planar. It is understood that, in an embodiment with reduced portions, the reduced portions are not substantially planar with the non-reduced portions. The second body second vertical sidewall 60 is generally planar and, in an exemplary embodiment, includes a longitudinal protrusion, i.e. a "key" 66. In an exemplary embodiment, the second body key 66 is a generally trapezoidal protrusion having the minor side offset from the planar portions of the generally planar second body second vertical sidewall 60. Thus, the second body second sidewall 60 is a keyed sidewall 68. In an exemplary embodiment, the second body key 66 loosely corresponds to the first body key 36. The nature of the second body key 66 loosely corresponding to the first body key 36 is detailed below.

In an exemplary embodiment, the second body 50 further includes a number of vertical passages 70 therethrough. If the second body 50 is hollow, a passage is defined by an opening 72 through the second body upper and lower sidewalls 62, 64. In an exemplary embodiment, not shown, the second body number of vertical passages 70 includes a number of closely spaced, generally circular openings. In an exemplary embodiment, the second body number of vertical passages 70 includes a number of slots, i.e. longitudinally elongated openings 72 spaced along the length of the second body 50. In either configuration, the positioning of the second body vertical passages 70 allows for positioning support assembly rods 90, 100 at almost any longitudinal location along the second body 50.

In an exemplary embodiment, one, or both, of the second body first and second ends 52, 56 includes an extension assembly 80 (FIG. 1). As detailed below, the second body 50 moves relative to the first body 20. The extension assembly 80 assists in such a movement. For example, in an exemplary embodiment, the extension assembly 80 includes a handle (not shown) disposed at one, or both, of the second body first and second ends 52, 56. In another exemplary embodiment, the extension assembly 80 includes a grappling point such as, but not limited to an opening 81 to which a hook (not shown) may be attached.

The first and second bodies 20, 50 may be made from any material but, in an exemplary embodiment, are made from plastic, aluminum, or steel. In another exemplary embodiment, the first and second bodies 20, 50 are made from an adhesion resistant material such as, but not limited to aluminum, stainless steel, nylon, Teflon® by DuPont, PVC (Poly (vinyl chloride)), ABS (Acrylonitrile butadiene styrene), or UMHW (Ultra-high-molecular-weight polyethylene). In another exemplary embodiment, a metal body 20, 50, or the vertical sides of the bodies 28, 30, 58, 60, is coated with an adhesion resistant coating such as but, not limited to nylon, Teflon® by DuPont, PVC, ABS, or UMHW, thereby providing an adhesion resistant surface. Further, the generally rectangular first body 20 has, in an exemplary embodiment, a cross-sectional area that is one of 2×4 inches, 2×6 inches, 2×8 inches, or 2×10 inches. Further, in an exemplary embodiment, the first and second bodies 20, 50 are long bodies. In another embodiment, the first and second bodies 20, 50 each have a length of about 8.0 feet. In another embodiment, the first and second bodies 20, 50 each have a length of about 2.0 feet, 4.0 feet, or 10.0 feet.

In an exemplary embodiment, the first and second support assemblies 16, 18 are similar and, as such, the elements thereof will only be described once. It is understood however that each of the first and second support assemblies 16, 18 include the described elements. In an exemplary embodiment, shown in FIG. 1, the first and second support assemblies 16, 18 include a number of elongated rods 90 and a number of elongated support pins 92. In an exemplary embodiment, each support assembly rod 90 is generally cylindrical and includes a number of substantially radial passages 94. The radial passages are spaced longitudinally along each support assembly rod 90. In an exemplary embodiment, each radial passage 94 are not parallel to an adjacent radial passage 94. In an exemplary embodiment, each radial passage 94 extends about ninety degrees relative to an adjacent radial passage 94. That is, one radial passage 84 extends between 12:00 o'clock and 6:00 o'clock and the adjacent radial passage(s) 94 extend between 9:00 o'clock and 3:00 o'clock, when the support assembly rod 90 is viewed axially. The support pins 92 are elongated and have a length that extends beyond the diameter of the support assembly rod 90. In an exemplary embodiment, the support assembly rod 90 has a diameter of about 0.75 inch. The support pins 92 length varies depending upon the soil conditions, as is known in the art.

In another embodiment, shown in FIG. 3, the first and second support assemblies 16, 18 include a number of threaded rods 100 and a number of threaded collars 102. The threaded rods 100, in an exemplary embodiment, are threaded only over the medial portion of the rod 100. In an exemplary embodiment, on the first body 20, each threaded collar 102 is disposed about a first body vertical passages 40 on the first body lower sidewall 34. In an alternate embodiment, each threaded collar 102 is disposed about a first body vertical passages 40 on the first body upper sidewall 32. On the second body 50, if the second body vertical passages 70 are slots, the collar 102 has a diameter that is wider than the narrow dimension of the slot. Further, the collar 102 is disposed below the second body lower sidewall 64. In another embodiment, the collar 102 is disposed on a carriage (not show) movably coupled to the second body upper sidewall 62. The carriage is structured to move longitudinally along second body vertical passages 70. Each threaded rod 100 is movably coupled to a collar 102 and rotation of the threaded rod 100 causes the threaded rod 100 to move vertically. To avoid contamination by concrete, the threads are large, i.e. "course" threads, as is known in the art. In an exemplary embodiment, either embodiment of the first and second support assemblies 16, 18, the lower tip of the rods 90 or threaded rods 100 are generally conical.

The concrete form assembly 10 is assembled as follows. The second body 50 is slidably disposed in the first body 20. In this configuration, the second body 50 is structured to move between a retracted first position, wherein the second body 50 is substantially disposed within the first body 20, and a second position, wherein the second body 50 extends from the first body 20. In an exemplary embodiment, when the second body 50 is in the second position, the second body 50 is almost fully extended from the first body 20. It is understood that there are a number of medial positions between the first and second positions. The second body 50 may extend from either the first body first end 22 or the first body second end 26, however, for the purpose of the following discussion it is assumed that the second body 50 extends from the first body second end 26. When in the second position, the first body second end 26 and the second body first end 52 overlap.

To maintain the second body 50 in the second position, or in a medial position, the first member assembly 12 includes a number of locking devices 110 (FIG. 1). In an exemplary embodiment, a locking device 110 is disposed on the first body upper sidewall 32 at about the middle of the first body 20. Further, in an exemplary embodiment, a locking device 110 is disposed at each of the first body first end 22 and the first body second end 26. In an exemplary embodiment, the locking device 110 includes a threaded collar 112, an opening 114, and a bolt 116. Each locking device collar 112 is coupled, and in an exemplary embodiment fixed, to the first body upper sidewall 32, about a locking device opening 114. Each locking device bolt 116 is threadably coupled to an associated locking device collar 112. To lock the first and second bodies 20, 50 in a relative position, a locking device bolt 116 is drawn down to engage the second body 50.

In an embodiment wherein the second body 50 includes a reduced portion 59 at one end 52, 56, when the second body is in the second position, the second body 50 is further in an offset position wherein a portion of the second body 50 outer surface substantially aligns with a portion of the first body 20 outer surface. In an exemplary embodiment, when the second body 50 is in the offset position, the first body upper sidewall 32 and the second body upper sidewall 62 are substantially coplanar. In an exemplary embodiment, this is accomplished as follows.

A first support assembly rod 90 is positioned, e.g. driven into the ground. Then a number of second support assembly rods 90 are positioned as well. As is known, the first and second support assembly rods 90 are spaced with at least one rod 90 at each end and one rod 90 in a medial position. For example, in an exemplary embodiment wherein the first body 20 and the second body 50 are each about 8.0 feet long, a first support assembly rod 90, is spaced about 1.0 foot from the first body first end 22, a second support assembly rod 90, is spaced about 4.0 feet from the first body first end 22, and a third support assembly rod 90, is spaced about 1.0 foot from the first body second end 26. The first and second support assembly rods 90 are disposed substantially in a line when positioned. When the second support assembly rods 90 are positioned, a measuring device, such as but not limited to a laser level, is utilized so as to position the second support assembly rod radial passages 94 to be offset, i.e. higher, than the first support assembly rod radial passages 94. The second support assembly rod radial passages 94 are offset by a distance substantially corresponding to the amount of offset of the reduced portion 59 which, in an exemplary embodiment, corresponds to the thickness of the first body upper sidewall 32. Support pins 92 are then positioned in the first and second support assembly rod radial passages 94 at a selected elevation. That is, the support pins 92 are positioned in the first and second support assembly rod radial passages 94 that, but for the offset noted above, are at the same general elevation.

The second body 50 is moved to the second position. The first and second bodies 20, 50 are then positioned above the first and second support assemblies 16, 18 with the support assembly rods 90 aligned with either a first body vertical passage 40 or a second body vertical passage 70. The first and second bodies 20, 50 are then lowered until the support assembly rods 90 pass through a first body vertical passage 40 or a second body vertical passage 70. The first and second bodies 20, 50 are further lowered until the first and second body lower sidewalls 34, 64 contact a support pin 92. In this configuration, and because the support pins 92 in the first and second support assemblies 16, 18 are offset, the first body 20 is disposed at a first elevation and the second body 50 is at a second elevation. That is, the second body 50 is slightly higher than it was when in the first position. This offset positions the first body upper sidewall 32 and the second body upper sidewall 62 to be substantially coplanar. Further, the second body first end 52, i.e. the reduced portion 59, is positioned in the first body second end 26 with the second body upper sidewall 62 contacting the first body inner surface 27, i.e. the underside of the first body upper sidewall 32.

Accordingly, the first support assembly 16 is structured to position the first body 20 in a first orientation relative to the ground or other substrate. The second support assembly 18 is structured to position the second body 50 in a second orientation relative to the ground or other substrate. The second body 50 orientation is substantially parallel to the first body 20 orientation. That is, the longitudinal axes of the two bodies 20, 50 are substantially parallel but offset from each other. In an embodiment wherein the first and second support assemblies 16, 18 include threaded components, the same offset is accomplished by positioning the threaded collars 102 on the first and second support assemblies 16, 18 at different elevations.

It is noted that, to allow for the shift of the second body 50 relative to the first, the second body keyed sidewall 68 is constructed with the key 66 having a slightly smaller cross-section than the first body key 36. In an exemplary embodiment, the second body keyed sidewall 68 has the key 66 set lower, i.e. the longitudinal axis of the second body key 66 is parallel, but lower than the longitudinal axis of the first body key 36. Thus, when the second body 50 is shifted upwardly, the upper surface of the two key 36, 66 are substantially aligned.

It is further noted that, when the second body first and second ends 52, 56 are reduced, multiple concrete forms 10 can be disposed in series. That is, for example, a second body second end 56 from one concrete form 10 can be disposed in the first body first end 22 of an adjacent concrete form 10. In this manner, the concrete forms 10 are use to create and extended forming surface. Further, each second body 50 is offset as described above so that, for example, all the upper sidewalls 32, 62 are generally coplanar over the series of concrete forms 10.

In an embodiment wherein the first body 20 includes a support assembly opening 46, and in an embodiment wherein the second body number of vertical passages 70 are spaced, generally circular openings, the medial support assembly rod 90 is passed through the first body 20 includes a support assembly opening 46 as well as the first body vertical passage 40 on the first body upper sidewall 32. The support assembly rod 90 passed through both bodies 20, 50 prevents the bodies 20, 50 from shifting longitudinally relative to each other. Further, the larger first body support assembly opening 46 allows for the second body 50 to rest on the support pin 92 at the medial support assembly rod 90.

Further, the second body 50 may be disposed in a medial position. In this configuration, the second body medial portion medial portion 54 is positioned in the first body second end 26. In this configuration, there is a difference in elevation between the first body upper sidewall 32 and the second body upper sidewall 62. When the first body upper sidewall 32 is a thin sidewall, and/or when the first and second bodies 20, 50 substantially correspond to each other, the difference in elevation is minimal and does not interfere with screeding the concrete after pouring.

Further, in this configuration, the concrete form assembly 10 includes two forming surfaces 120, 122. That is, either the first and second body first sidewalls 28, 58 form a first forming surface 120, and, the first and second body second vertical sidewalls 30, 60 form a second forming surface 122. Thus, the concrete forming assembly 10 may be used in two orientations.

Figure 4:
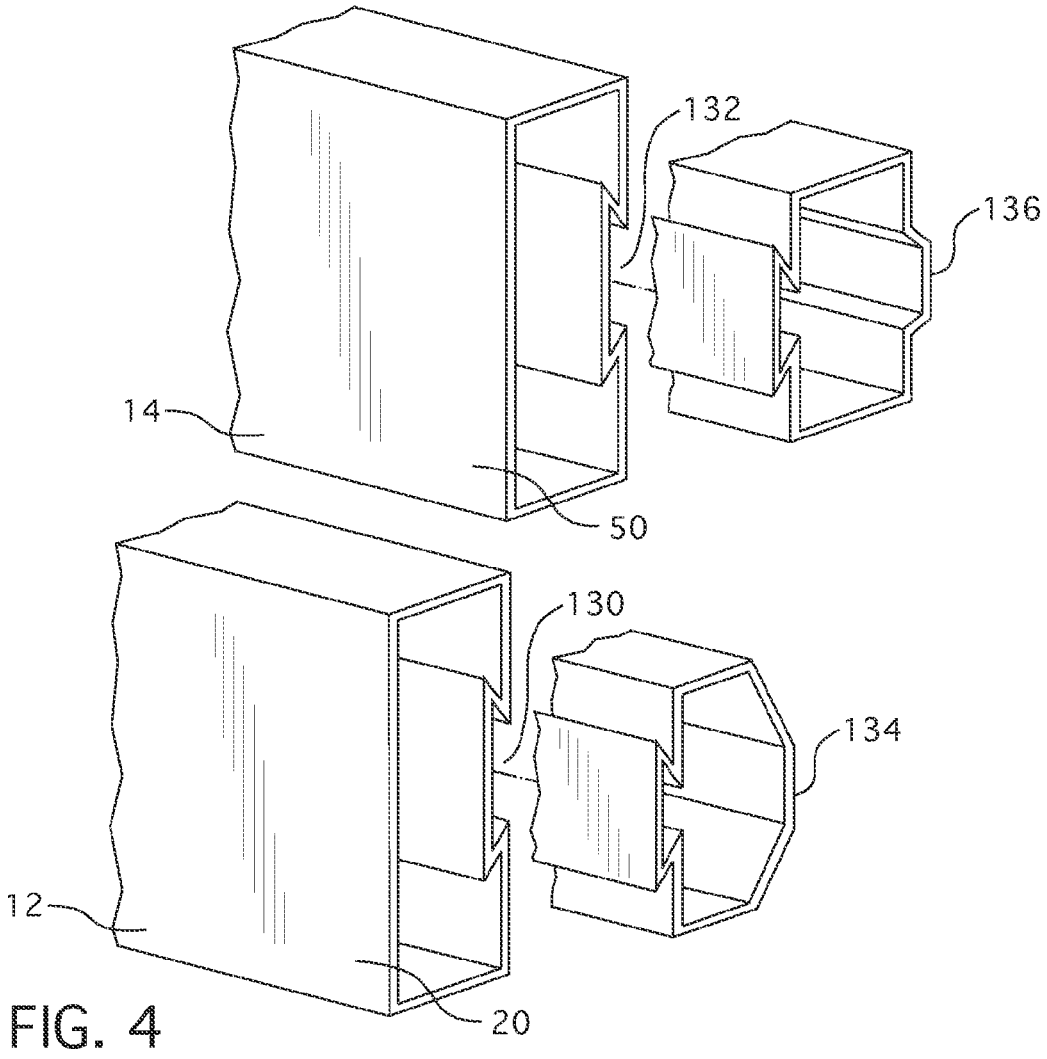
FIG. 4 is an exploded isometric view of another embodiment of a concrete form assembly.

In an alternate embodiment, FIG. 4, the first and second body keys 36, 66 are not unitary with the first and second bodies 20, 50, respectively. That is, the first and second bodies 20, 50 each include a longitudinal coupling 130, 132, respectively, and the first member assembly 12 includes a separable first key member 134, and the second member assembly 14 includes a separable second key member 136. The separable key members 134, 136 each include a coupling that corresponds to the first and second body longitudinal couplings 130, 132. For example, if the first and second body longitudinal couplings 130, 132 are trapezoidal grooves, the separable key members 134, 136 each include a trapezoidal tongue. The separable key members 134, 136 may have any key shape and, in an exemplary embodiment, more than one separable key member 134, 136, each with a different key shape, is provided for each body 20, 50. Thus, a user may select a separable key member 134, 136 of a desired shape.

Figure 5:
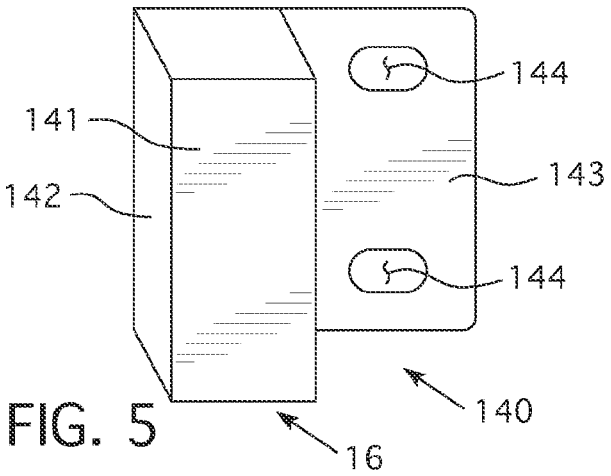
FIG. 5 is an isometric view of a support assembly.

In an alternate embodiment, the support assemblies 16, 18 are plugs 140, shown in FIG. 5, structured to be coupled to the outer ends of the first and second bodies 20, 50, for example, the first body first end 22 and the second body second end 56. For this embodiment of the support assemblies 16, 18, the second body 50 is also a hollow body and includes an inner surface 55. The plugs 140 are generally similar and only one is described. The plug 140 includes a body 141 including a thick portion 142 and a flange 143. The plug body thick portion 142 is sized to correspond to the first or second body inner surface 27, 55 (thus the plug body thick portion 142 for the second body 50 will be slightly smaller than the plug body thick portion for the first body 20). The distal end of each plug body thick portion 142 are, in an exemplary embodiment, tapered or chamfered. Accordingly, in an exemplary embodiment, the plug body thick portion 142 is a parallelepiped. The plug flange 143 is a planar member that is, in an exemplary embodiment, generally coplanar with one side of the plug body thick portion 142. The plug flange 143 includes a number of fastener passages 144 that extend generally normal to the plane of the plug flange 143.

In this exemplary embodiment, the plugs 140 are coupled to the first and second bodies 20, 50 at the outer ends, for example, the first body first end 22 and the second body second end 56. That is, the plug body thick portion 142 is disposed in the hollow first and second bodies 20, 50. The plug flange 143 extends beyond the perimeter of the associated body 20, 50. In this configuration, each plug 140 is structured to be coupled to a vertical surface, for example, the opposing vertical sides of a door frame (not shown). The plugs 140 can be coupled to the vertical surface by fasteners (not shown) that are passed through the plug flange fastener passages 144. The concrete forming assembly 10, in an exemplary embodiment, includes a number of utilization assemblies 150. Each utilization assembly 150 is a construct or assembly that aids in the use of the concrete forming assembly 10. For example, one utilization assembly 150 is a handle 150A, or a number of handles 150A, coupled to the first member upper sidewall 32. In an exemplary embodiment, the handles 150A are inverted U-shaped members. A further utilization assembly 150 is a level 150B, such as but not limited to a bubble level, coupled to the first member 20. Such a level 150B may be disposed below an inverted U-shaped handle 150A for protection. Another utilization assembly 150 is a longitudinal measuring system 150C, such as, but not limited to, a graduated indicia disposed on one or both of the first and second bodies 20, 50. Another utilization assembly 150 is a support rod enclosure 150D structured to store the support rods 90, 100 within the second body 50. Another utilization assembly 150 is an elastic coupling 150E, such as, but not limited to a bungee with hooks on the ends or a band, as shown, that is structured to couple the rod 90, 100 to the first or second body 20, 50. That is, for example, the elastic coupling is looped over, or coupled to the upper portion of the rod 90, 100, then stretched over the outer side of first or second body 20, 50 and looped over, or coupled to, the lower portion of the rod 90, 100. Such an elastic coupling 150E assists in maintaining the first and second bodies 20, 50 in the desired orientation. Further, the extension assembly 80 described above is another utilization assembly 150.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A concrete form assembly comprising:

a hollow first member assembly including an elongated body with a first end, a medial portion, a second end, an inner cross-sectional shape and a generally planar vertical first side;

a second member assembly including an elongated body with a first end, a medial portion, a second end, said second member medial portion outer cross-sectional shape corresponds to said first body inner cross-sectional shape;

wherein said second body is slidably disposed within said first body and structured to move between a retracted first position, wherein said second body is substantially disposed within said first body, and a second position, wherein said second body extends from said first body;

wherein said second body first end is a reduced portion; and wherein, when said second body is in said second position, said second body is further in an offset position wherein a portion of the second body outer surface substantially aligns with a portion of the first body outer surface.

2. The concrete form assembly of claim 1 wherein:

said first body has a generally rectangular cross-section including a second vertical sidewall, an upper sidewall and a lower sidewall;

said second body has a generally rectangular cross-section including a first vertical sidewall, a second vertical sidewall, an upper sidewall and a lower sidewall:

said first body upper sidewall is substantially planar;

said second body upper sidewall is substantially planar; and wherein, when said second body is in said offset position, said first body upper sidewall and said second body upper sidewall are substantially coplanar.

3. The concrete form assembly of claim 2 wherein:

said first body first vertical sidewall is substantially planar;

said second body first vertical sidewall is substantially planar, and wherein, when said second body is in said offset position, said first body first vertical sidewall and said second body first vertical sidewall are substantially coplanar.

4. The concrete form assembly of claim 2 wherein:

said first body second vertical sidewall is a keyed sidewall;

said second body second vertical sidewall is a keyed sidewall; and wherein, when said second body is in said offset position, said first body second vertical sidewall and said second body second vertical sidewall are substantially coplanar.

5. The concrete form assembly of claim 1 wherein:

said first member assembly includes a first support assembly;

said second member assembly includes a second support assembly;

said first support assembly structured to position said first body in a first orientation;

said second support assembly structured to position said second body in a second orientation; and wherein said second body orientation is substantially parallel to said first body orientation.

6. The concrete form assembly of claim 5 wherein:

said first body includes a number of vertical passages therethrough;

said second body includes a number of vertical passages therethrough;

said first support assembly includes a number of elongated rods and a number of elongated support pins;

each said first support assembly rod including a number of substantially radial passages;

each first support assembly support pin sized to correspond to a first support assembly rod passage;

said second support assembly includes a number of elongated rods and a number of elongated support pins;

each said second support assembly rod including a number of substantially radial passages;

each said first support assembly rod extending through a first body passage;

each said first support assembly support pin disposed in a first support assembly rod passage, each said first support assembly support pin supporting said first body;

each said second support assembly rod extending through a second body passage; and each said second support assembly support pin disposed in a second support assembly rod passage, each said second support assembly support pin supporting said second body.

7. The concrete form assembly of claim 6 wherein:

one said first body passage disposed at said first body second end;

said first body second end does not include a lower side;

one said second body passage aligned with said first body second end passage; and one said second support assembly rod extending through said first body second end passage and a second body passage.

8. The concrete form assembly of claim 5 wherein:

said first body includes a number of vertical passages therethrough;

said second body includes a number of vertical passages therethrough;

said first support assembly includes a number of threaded, elongated rods and a number of threaded collars;

said second support assembly includes a number of threaded, elongated rods and a number of threaded collars;

each said first support assembly threaded collar disposed at a first body vertical passage;

each said second support assembly threaded collar disposed at a second body vertical passage;

each said first support assembly threaded rod extending through a first body passage and rotatably coupled to an associated first support assembly threaded collar; and each said second support assembly threaded rod extending through a second body passage and rotatably coupled to an associated second support assembly threaded collar.

* * * * *